US006601504B2

(12) United States Patent
Kanayama

(10) Patent No.: US 6,601,504 B2
(45) Date of Patent: Aug. 5, 2003

(54) CYLINDER APPARATUS FOR ROTARY PRINTING PRESS

(75) Inventor: Tomoya Kanayama, Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/892,032

(22) Filed: Jun. 25, 2001

(65) Prior Publication Data

US 2001/0054361 A1 Dec. 27, 2001

(30) Foreign Application Priority Data

Jun. 23, 2000 (JP) ..... 2000-189457

(51) Int. Cl.[7] ..... B41F 7/02
(52) U.S. Cl. ..... 101/218; 101/247; 101/248
(58) Field of Search ..... 101/137, 139, 101/140, 143, 144, 145, 177, 182, 184, 185, 216, 218, 247, 248

(56) References Cited

U.S. PATENT DOCUMENTS 3,786,749 A * 1/1974 Vir Singh ..... 101/140
4,524,712 A * 6/1985 Ito ..... 101/352.05
4,569,306 A * 2/1986 Ito et al. ..... 101/183
4,833,982 A * 5/1989 Liebert et al. ..... 101/177
5,311,817 A 5/1994 Funada
5,320,038 A * 6/1994 Fischer ..... 101/177
5,722,323 A * 3/1998 Whiting et al. ..... 101/185
6,347,585 B1 * 2/2002 Kiamco et al. ..... 101/247

FOREIGN PATENT DOCUMENTS

JP 64-42135 3/1989

* cited by examiner

*Primary Examiner*—Ren Yan
(74) *Attorney, Agent, or Firm*—Blakely, Sokoloff, Taylor & Zafman

(57) ABSTRACT

A cylinder apparatus for a rotary printing press includes a pair of inner bearings, an outer bearing, a pair of frames, a pair of cylinders, a motor, and a pair of abutting members. The pair of inner bearings rotatatively support two end shafts of at least one plate cylinder. The inner bearings have engaging projections. The outer bearing pivotally supports one of the inner bearings. The pair of frames are arranged to oppose each other through a predetermined distance, and pivotally support the outer bearing and the other one of the inner bearings. The pair of cylinders pivot the inner bearings supported by one of the frames and the outer bearing. The motor pivots the outer bearing supported by the other one of the frames. The pair of abutting members are supported by the frames. The engaging projections of the inner bearings abut against the pair of abutting members when the plate cylinder abuts against a blanket cylinder upon driving operation of the cylinders.

12 Claims, 4 Drawing Sheets

CYLINDER APPARATUS FOR ROTARY PRINTING PRESS

BACKGROUND OF THE INVENTION

The present invention relates to a cylinder apparatus for a rotary printing press which adjusts throw-on and throw-off of cylinders in contact opposite to each other, and the skew of a cylinder.

In various types of multicolor rotary printing presses such as an offset printing press, if plates mounted on the plate cylinders are misregistered among printing units of a plurality of ink colors, the images of the respective ink colors are printed misregistered. In view of this problem, a cylinder apparatus for a rotary printing press of this type has a plate registration unit for adjusting register of plates. U.S. Pat. No. 5,311,817 (reference 1) discloses a cylinder apparatus for a rotary printing press of this type. According to U.S. Pat. No. 5,311,817, both end shafts of a plate cylinder 66 are rotatably supported by the right and left frames 51 through the eccentric bearings 67, and the piston rods 70 of the cylinders 69 are connected to the eccentric bearings 67. The plate cylinder 66 is moved into contact with, and away from, the rubber blanket cylinders 53 by rotating the eccentric bearings 67 by making the piston rods 70 move forward and backward. Further, the eccentric cam 71 restricting the amount of revolution of the eccentric bearing 67 rotates by operating together with the position adjustment of the rubber blanket cylinder 53 when the thickness of a sheet is changed. As a result, the printing pressure of the rubber blanket cylinder 53 and the plate cylinder 66 becomes constant, regardless of the position of the rubber blanket cylinder 53.

The object of the present invention is to provide a drum unit of a rotary printing press, which has improved the printing quality by preventing clattering of a plate cylinder during the printing operation, by enabling to make a twist adjustment.

However, according to such a conventional unit, there has been a problem of not being able to make a plate registration by moving and adjusting one minor axis only of a plate cylinder, which is a so-called twisting adjustment.

SUMMARY OF THE INVENTION

It is an object of the present invention to provide a cylinder apparatus for a rotary printing press which improves printing quality.

In order to achieve the above object, according to the present invention, there is provided a cylinder apparatus for a rotary printing press, comprising a pair of first eccentric bearings for rotatatively supporting two ends of at least one first cylinder, the first eccentric bearings having abutting portions, a second eccentric bearing for pivotally supporting one of the first eccentric bearings, a pair of support members arranged to oppose each other through a predetermined distance and adapted to pivotally support the second eccentric bearing and the other one of the first eccentric bearings, a pair of first driving means for pivoting the first eccentric bearings supported by one of the support members and the second eccentric bearing, second driving means for pivoting the second eccentric bearing supported by the other one of the support members, and a pair of abutting members which are supported by the support members and against which the abutting portions of the first eccentric bearings abut when the first cylinder abuts against a second cylinder upon driving operation of the first driving means.

DESCRIPTION OF THE PREFERRED EMBODIMENTS

The present invention will be described in detail with reference to the accompanying drawings.

Figure 1:
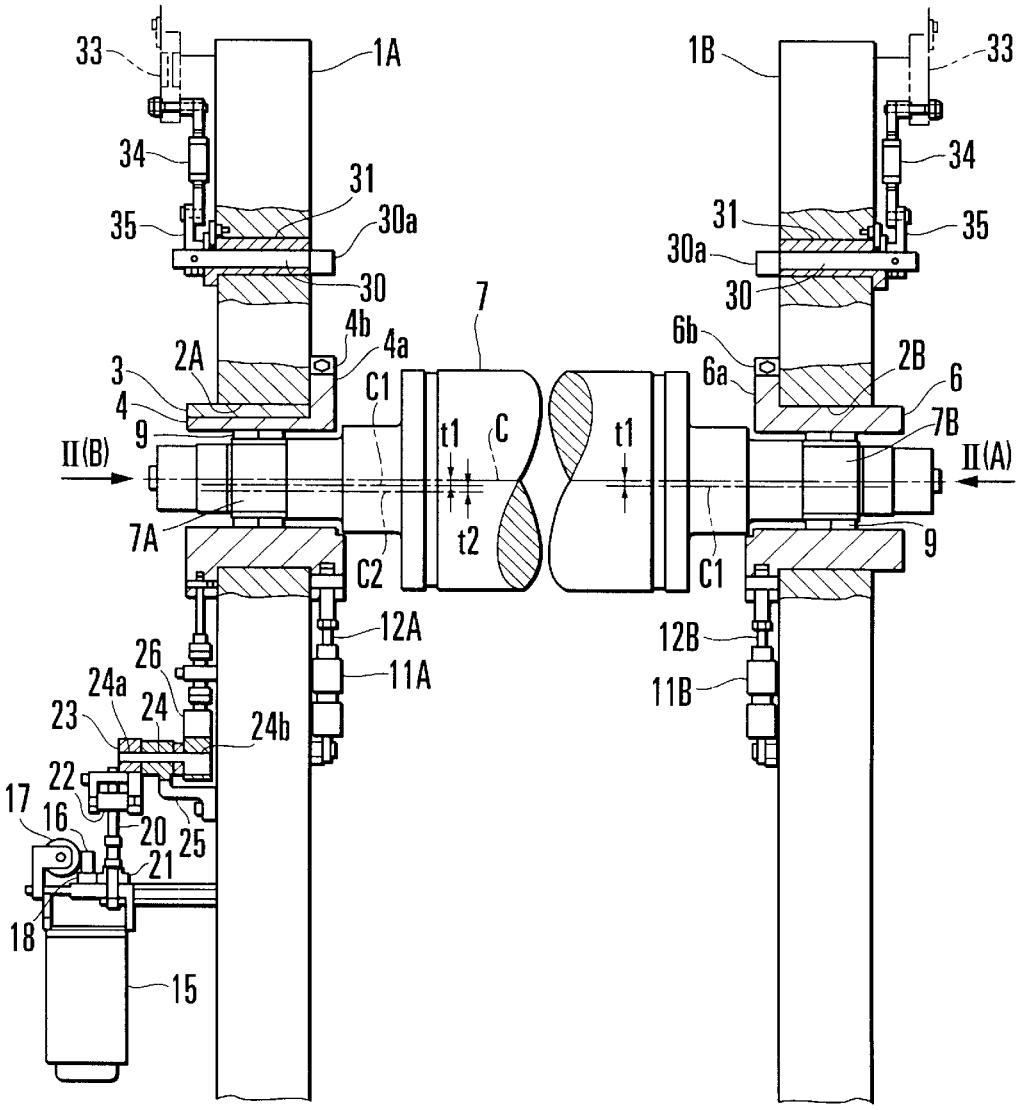
FIG. 1 is a developed partially cutaway front view of a cylinder apparatus for a rotary printing press according to an embodiment of the present invention.
Figure 2B:
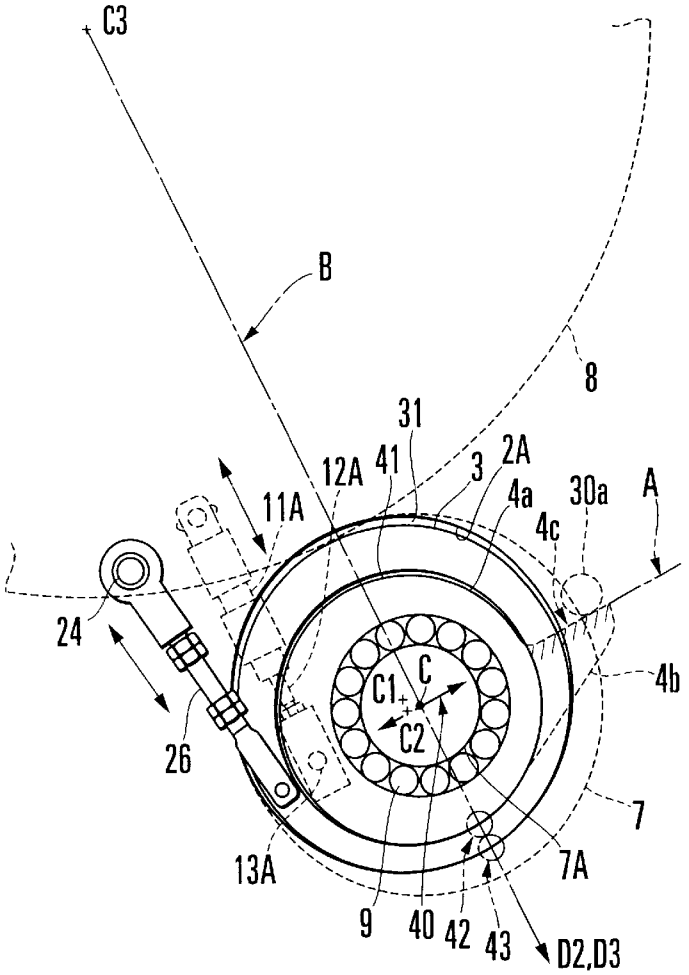
FIG. 2B is a view taken along the line of arrow IIB of FIG. 1.

FIG. 1 shows a cylinder apparatus for a rotary printing press according to the first embodiment of the present invention. Referring to FIG. 1, a pair of frames 1A and 1B oppose each other through a predetermined gap. An outer bearing 3 serving as the second eccentric bearing is pivotally mounted in a bearing hole 2A formed in the frame 1A, and an inner bearing 4 serving as the first eccentric bearing is pivotally mounted on the outer bearing 3. As shown in FIG. 2B, clearances 31 and 41 are set between the bearing hole 2A and the outer surface of the outer bearing 3 and between the inner surface of the outer bearing 3 and the outer surface of the inner bearing 4, respectively, and lubricating oil is to be supplied there, so that the outer and inner bearings 3 and 4 can pivot smoothly.

Referring to FIG. 1, an engaging projection 4*b* with a radially flat engaging surface 4*c* to abut against an abutting member 30*a* (to be described later) projects from the peripheral edge of a flange 4*a* in contact opposite to the inner surface of the frame 1A of the inner bearing 4. As shown in FIG. 2B, a forming direction A in which the engaging surface 4*c* of the engaging projection 4*b* is formed substantially coincides with the skew direction 40 of the plate cylinder 7 in which the plate cylinder 7 moves when the outer bearing 3 is pivoted.

The frame 1B has a bearing hole 2B. An inner bearing 6 serving as the first eccentric bearing is pivotally mounted in the bearing hole 2B, and a clearance 61 is set between the outer surface of the inner bearing 6 and the bearing hole 2B. An engaging projection 6*b* with a radially flat engaging surface 6*c* to abut against another abutting member 30*a* projects from a flange 6*a* in contact opposite to the inner surface of the frame 1B of the inner bearing 6. The plate cylinder 7 is arranged in contact opposite to a blanket cylinder 8, and end shafts 7A and 7B of the plate cylinder 7 are rotatatively axially supported by the inner bearings 4 and 6 through bearings 9. Axes C1 of the inner bearings 4 and 6 are eccentric from an axis C of the plate cylinder 7 by t1, and an axis C2 of the outer bearing 3 is eccentric from the axis C1 of the inner bearing 4 by t2.

Figure 2A:
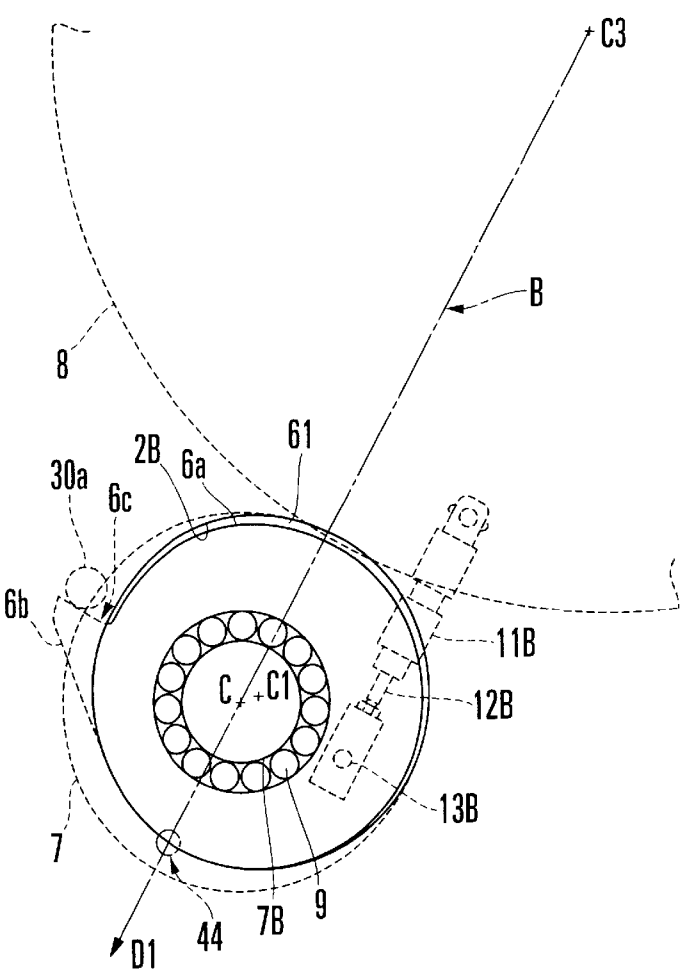
FIG. 2A is a view taken along the line of arrow IIA of FIG. 1.

A pair of cylinders 11A and 11B are pivotally mounted on the inner surfaces of the frames 1A and 1B so as to oppose each other. Rods 12A and 12B of the cylinders 11A and 11B are pivotally mounted on pivotal mount portions 13A and 13B of those flanges 4*a* and 6*a* of the inner bearings 4 and 6 which are in contact with the inner surfaces of the frames 1A and 1B. As shown in FIGS. 2A and 2B, the pivotal mount portions 13A and 13B and the engaging projections 4*b* and 6*b* of the inner bearings 4 and 6 are positioned such that they are phase-shifted from each other by substantially 180° through the axis C of the plate cylinder 7. The forward/backward moving directions of the rods 12A and 12B of the cylinders 11A and 11B are set substantially parallel to a line B that connects the axis C of the plate cylinder 7 and an axis C3 of the blanket cylinder 8. In FIGS. 2A and 2B, the inner bearings 4 and 6 and the outer bearing 3 are not shown.

In the cylinder apparatus with the above arrangement, referring to FIGS. 2A and 2B, when the rods 12A and 12B of the cylinders 11A and 11B move forward, the inner bearings 4 and 6 pivot around the end shafts 7A and 7B, respectively, of the plate cylinder 7, so the plate cylinder 7 pivots about the axes C1 of the inner bearings 4 and 6 as the pivot center. Upon pivot motion of the inner bearings 4 and 6, when the engaging projections 4*b* and 6*b* abut against the abutting members 30*a* of corresponding cam shafts 30 (to be described later), the inner bearing 6 slightly pivots clockwise in FIG. 2A about the corresponding abutting member 30*a* as the pivot center. Accordingly, part of the outer surface of the inner bearing 6 serves as an urging portion 44 to urge part of the inner surface of the bearing hole 2A of the frame 1A. The urging portion 44 is located on the extension of the line B that connects the axis C3 of the blanket cylinder 8 and the axis C of the plate cylinder 7.

Referring to FIG. 2B, the inner bearing 4 slightly pivots counterclockwise about the corresponding abutting member 30*a* as the pivot center. Accordingly, part of the outer surface of the inner bearing 4 serves as an urging portion 42 to urge part of the inner surface of the outer bearing 3. At a portion indicated by 43 in FIG. 2B, part of the outer surface of the outer bearing 3 serves as an urging portion 43 to urge part of the inner surface of the bearing hole 2A of the frame 1A. The urging portions 42 and 43 are located on the extension of the line B that connects the axis C3 of the blanket cylinder 8 and the axis C of the plate cylinder 7. In other words, an urging direction D1 with which the inner bearing 6 urges the bearing hole 2B at the urging portion 44, an urging direction D2 with which the inner bearing 4 urges the outer bearing 3 at the urging portion 42, and an urging direction D3 with which the outer bearing 3 urges the bearing hole 2A at the urging portion 43 coincide with the direction of the line B.

Referring to FIG. 1, a motor 15 is fixed to the frame 1A through a stud. The motor 15 has a potentiometer 17 for detecting the rotational speed of a motor shaft 16, and a gear 18 is axially mounted on the motor shaft 16. The gear 18 meshes with a gear 21 axially mounted on a shaft 20. The shaft 20 is rotatatively supported and its movement in the axial direction is regulated. A piece 22 threadably engages with a threaded portion formed at the distal end of the shaft 20. The piece 22 is pivotally mounted on one end of a lever 23. A transmission shaft 24 has an eccentric small-diameter portion 24*a* and large-diameter portion 24*b*, and is pivotally supported by a support member 25 fixed to the frame 1A. The small-diameter portion 24*a* of the transmission shaft 24 is fitted and fixed in a hole formed in the other end of the lever 23.

The large-diameter portion 24*b* of the transmission shaft 24 is fitted and fixed in a hole formed in one end of a lever 26. The other end of the lever 26 is pivotally mounted on the flange of the outer bearing 3. In this arrangement, when the motor 15 is driven and the rotation of the motor shaft 16 is transmitted to the shaft 20 through the gears 18 and 21, the lever 23 is pivoted through the piece 22 about the transmission shaft 24 as the pivot center, so the transmission shaft 24 also pivots together with the lever 23. Pivot motion of the transmission shaft 24 is transmitted to the lever 26 through the large-diameter portion 24*b*, so the lever 26 moves in the direction of arrows as shown in FIG. 2B. Upon movement of the lever 26, the outer bearing 3 pivots clockwise or counterclockwise in FIG. 1. As the axis C2 of the outer bearing 3 is eccentric from the axis C1 of the inner bearing 4, upon pivot motion of the outer bearing 3, the plate cylinder 7 moves in the skew direction indicated by an arrow 40 in FIG. 2B.

Referring to FIG. 1, cam shafts 30 are pivotally supported in the holes of the frames 1A and 1B through bushes 31. One end of each of the cam shafts 30 respectively projecting from inside the frames 1A and 1B has the eccentric cam-shaped abutting member 30*a*. Disks 33 are pivotally supported by the bearings of the blanket cylinder 8, and are pivotally adjusted by operation members (not shown). One end of each link 34 is pivotally mounted on a corresponding disk 33, and one end of a corresponding lever 35 is pivotally mounted on the other end of this link 34. The other end of the lever 35 is axially mounted on the other end of the corresponding one of the cam shafts 30 projecting outside the frames 1A and 1B. In this arrangement, when the disks 33 are pivotally adjusted, the cam shafts 30 pivot through the links 34 and levers 35. Upon pivot motion of the cam shafts 30, in FIG. 2B, the abutting position where the engaging projection 4*b* of the inner bearing 4 abuts against the corresponding abutting member 30*a* is adjusted, thereby adjusting the nip pressure between the plate cylinder 7 and blanket cylinder 8.

The throw-on and throw-off operation of the plate cylinder 7 with respect to the blanket cylinder 8 in the cylinder apparatus for the rotary printing press with the above arrangement will be described.

When the rods 12A and 12B of the cylinders 11A and 11B move forward, the inner bearings 4 and 6 pivot around the end shafts 7A and 7B, as described above, so the plate cylinder 7 pivots about the axes C1 of the inner bearings 4 and 6 as the pivot center. Upon pivot motion of the plate cylinder 7, the engaging projections 4*b* and 6*b* abut against the abutting members 30*a* of the cam shafts 30, and the inner bearing 4 is urged against the outer bearing 3 at the urging portion 42. The outer and inner bearings 3 and 6 are urged against the bearing holes 2A and 2B at the urging portions 43 and 44, respectively, so the plate cylinder 7 comes into contact opposite to the plate cylinder 7 with an appropriate nip pressure.

Therefore, during printing, when the notches of the plate cylinder 7 and plate cylinder 7 oppose each other and after that the outer surfaces of the plate cylinder 7 and blanket cylinder 8 come into contact opposite to each other again, so the plate cylinder 7 tries to slightly move in the direction of diameter of the blanket cylinder 8, this movement is prohibited by the urging portions 42, 43, and 44. Hence, the plate cylinder 7 and blanket cylinder 8 are regulated from generating vibration due to their movement, and accordingly printing errors can be prevented.

In addition, the urging portions 42, 43, and 44 are positioned to be located on the extension of the line B that connects the axis C3 of the blanket cylinder 8 and the axis C of the plate cylinder 7. At the urging portion 44, the urging direction D1 with which the inner bearing 6 urges the bearing hole 2B coincides with the direction of the line B. At the urging portions 42 and 43, the urging direction D2 with which the inner bearing 4 urges the outer bearing 3 and the urging direction D3 with which the outer bearing 3 urges the bearing hole 2A coincide with the direction of the line B. Hence, as the direction of the movement of the plate cylinder 7 caused by the notches of the plate cylinder 7 and blanket cylinder 8 is from the axis C of the plate cylinder 7 toward the axis C3 of the blanket cylinder 8, that is, opposite to the urging directions D described above, the movement of the plate cylinder 7 is regulated. As a result, printing errors can be prevented more reliably.

If the skew direction of the plate cylinder 7 need be adjusted, the motor 15 is driven. Then, the rotation of the motor shaft 16 is transmitted to the shaft 20 through the gears 18 and 21, and the lever 23 is pivoted through the piece 22 about the transmission shaft 24 as the pivot center. When the lever 23 pivots, the transmission shaft 24 also pivots together with it. Pivot motion of the transmission shaft 24 is transmitted to the lever 26 through the large-diameter portion 24*b*, and the lever 26 moves in the direction of arrows as shown in FIG. 2B. Thus, the outer bearing 3 pivots clockwise or counterclockwise in FIG. 1, and the plate cylinder 7 moves in the skew direction indicated by the arrow 40. At this time, since the skew direction 40 along which the plate cylinder 7 moves coincides with the forming direction A of the engaging surface 4*c* of the engaging projection 4*b,* during skew adjustment, the positional relationship between the inner bearing 4 and the end shaft 7A of the plate cylinder 7 does not change. As a result, the nip pressure of the plate cylinder 7 with respect to the blanket cylinder 8 is appropriately maintained.

Figure 3B:
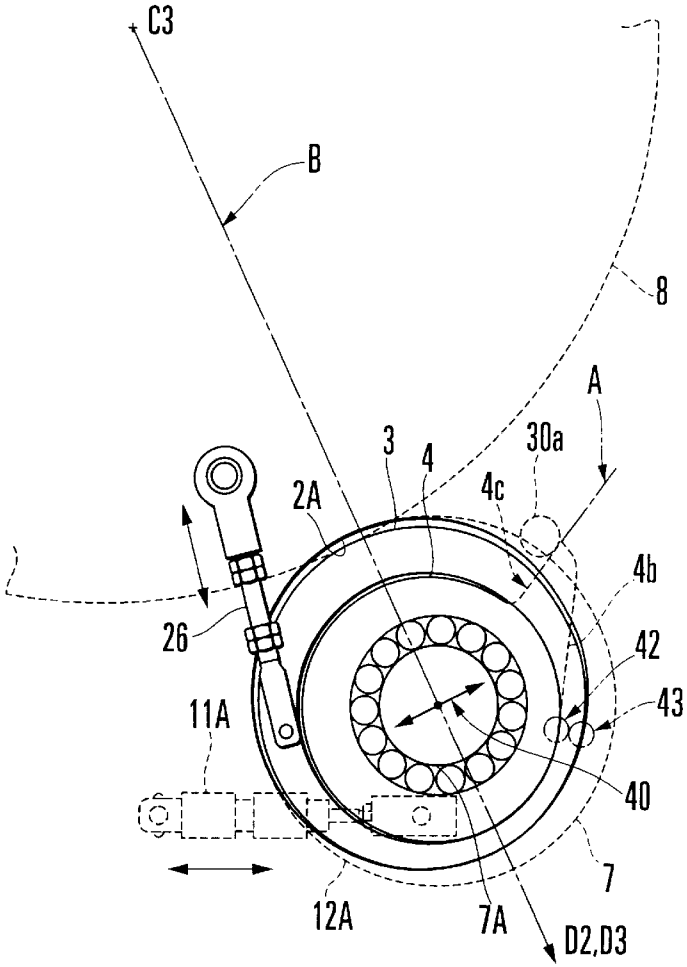
FIGS. 3A and 3B are views taken along the lines of arrows IIA and IIB, respectively, of FIG. 1 to show the second embodiment of the present invention.
Figure 3A:
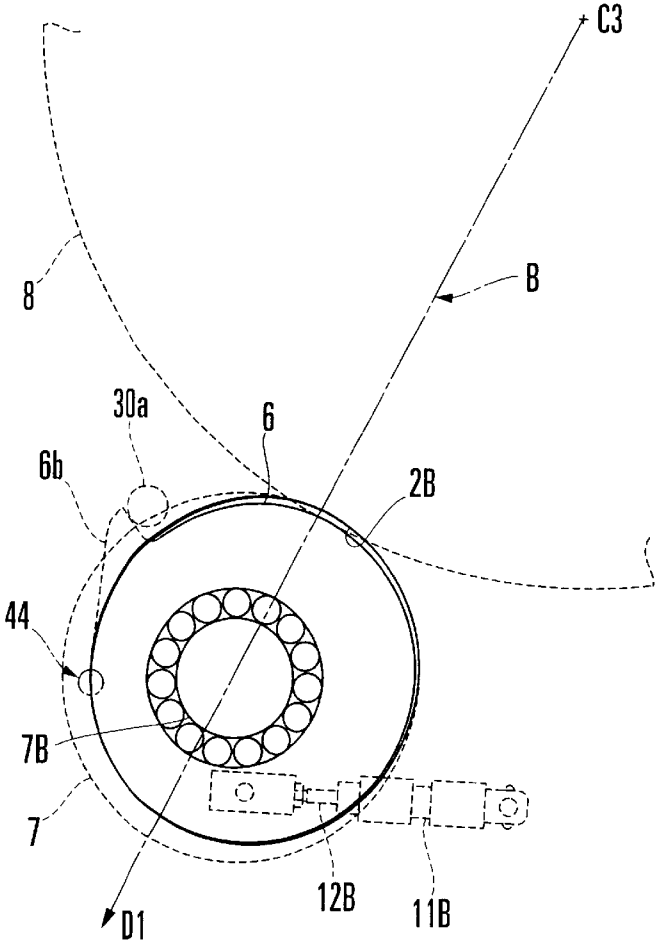

FIGS. 3A and 3B show a cylinder apparatus according to the second embodiment of the present invention.

The second embodiment is different from the first embodiment described above in that the forward/backward moving directions of rods 12A and 12B of cylinders 11A and 11B are not parallel to a line B and that a forming direction A of an engaging surface 4*c* of an engaging projection 4*b* does not coincide with a skew direction 40 of a plate cylinder 7.

In the cylinder apparatus with the above arrangement, when the rods 12A and 12B of the cylinders 11A and 11B are moved forward, inner bearings 4 and 6 pivot around end shafts 7A and 7B of the plate cylinder 7. Upon pivot motion of the inner bearings 4 and 6, when the engaging projection 4*b* and an engaging projection 6*b* abut against abutting members 30*a*, the inner bearings 4 and 6 slightly pivot about the abutting members 30*a* as the pivot centers. Hence, urging portions 42, 43, and 44 are formed at positions not on the extension of the line B.

In this case, if the driving forces of the cylinders 11A and 11B are set to a predetermined value or more, during printing, when the notch of the plate cylinder 7 and that of a blanket cylinder 8 oppose each other and the outer surfaces of the plate cylinder 7 and blanket cylinder 8 come into contact opposite to each other again, the plate cylinder 7 tries to slightly move in the direction of diameter of the blanket cylinder 8. However, since the urging portions 42, 43, and 44 are formed, movement of the plate cylinder 7 is prohibited. Therefore, the plate cylinder 7 and blanket cylinder 8 are regulated from generating vibration due to their movement, and accordingly printing errors can be prevented.

Figure 4:
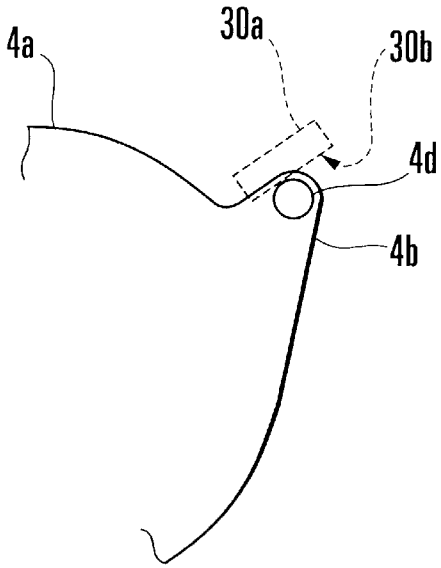
FIG. 4 is a view showing another example of the engaging portion where the engaging projection of the inner bearing and the abutting portion abut.

In the above embodiments, the engaging surface 4*c* and an engaging surface 6*c* are formed on the engaging projections 4*b* and 6*b*, respectively. Alternatively, as shown in FIG. 4, an engaging surface 30*b* may be formed on the abutting member 30*a*. In this case, a pin 4*d* standing upward from the engaging projection 4*b* of the inner bearing 4 abuts against the engaging surface 30*b* of the abutting members 30*a*. While FIG. 4 shows a modification of FIG. 2B, the same applies to FIG. 2A.

Figure 5:
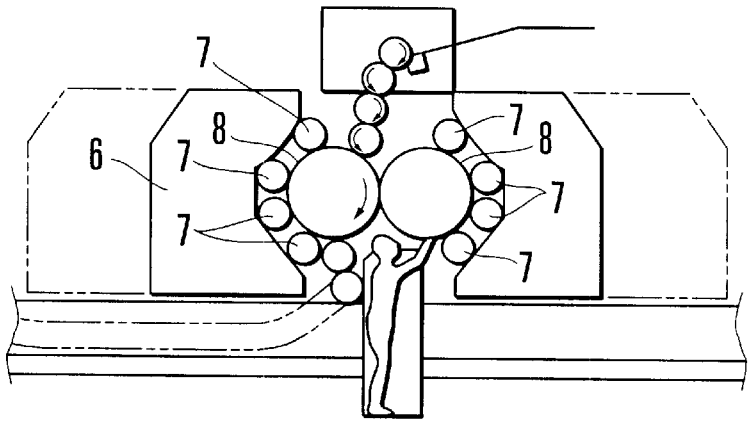
FIG. 5 is a side view showing the main part of a satellite type printing press to which the present invention is applied.

FIG. 5 shows a case in which the present invention is applied to a satellite type printing press. In the satellite type printing press, four plate cylinders 7 are arranged like satellites around a pair of blanket cylinders 8 in contact opposite to each other, to perform multicolor printing simultaneously. In the satellite type printing press with this arrangement as well, if frames 1A and 1B, inner bearings 4 and 6 with engaging projections 4*b* and 6*b*, an outer bearing 3, cylinders 11A and 11B, and abutting members 30*a* are provided to each plate cylinder 7, the present invention can be applied to the printing press, in the same manner as described in the above embodiments.

As has been described above, according to the present invention, since part of the first eccentric bearing is urged against part of the second eccentric bearing, during printing, these eccentric bearings do not cause backlash, so printing errors can be prevented. When skew registration is adjusted, since the nip pressure of one cylinder with respect to the other cylinder is maintained at almost a constant value, the printing quality is improved. When the notches of the two cylinders oppose during printing, movement of the cylinders is regulated, so that printing errors can be prevented more reliably.

What is claimed is:

1. A cylinder apparatus for a rotary printing press, comprising:

a pair of first eccentric bearings for rotatatively supporting two ends of at least one first cylinder, said first eccentric bearings having abutting portions;

a second eccentric bearing for pivotally supporting one of said first eccentric bearings;

a pair of support members arranged to oppose each other through a predetermined distance and adapted to pivotally support said second eccentric bearing and the other one of said first eccentric bearings;

a pair of first driving means for pivoting said first eccentric bearings supported by one of said support members and said second eccentric bearing;

second driving means for pivoting said second eccentric bearing supported by the other one of said support members; and a pair of abutting members which are supported by said support members and against which said abutting portions of said first eccentric bearings abut when said first cylinder abuts against a second cylinder upon driving operation of said first driving means, wherein throw-on and throw-off operations of the first cylinder to the second cylinder are performed by pivoting a pair of said first eccentric bearings, wherein skew adjustment of the first cylinder in relation to the second cylinder is performed by pivoting the second eccentric bearings, and wherein the abutting portions of the first eccentric bearings driven by the first driving means abut against said abutting members to form (1) a first urging portion from the other one of the first eccentric bearings to the support members, (2) a second urging portion from one of the first eccentric bearings to the second eccentric bearings and (3) a third urging portion from the second eccentric bearings to the support members.

2. An apparatus according to claim 1, wherein said abutting portions have abutting surfaces against which said abutting members abut, and the abutting surfaces are formed in substantially the same direction as a skew direction, wherein said skew direction is perpendicular to a line that connects axes of said first and second cylinders when the first and second cylinders are disposed substantially parallel with respect to each other.

3. An apparatus according to claim 1, wherein said second eccentric bearing pivots to skew said first cylinder in a skew direction that is perpendicular to a line that connects axes of said first and second cylinders when the first and second cylinders are disposed substantially parallel with respect to each other.

4. An apparatus according to claim 3, wherein said abutting a members have abutting surfaces against which the abutting portions abut, and the abutting surfaces are formed in substantially the same direction as the skew direction.

5. An apparatus according to claim 1, wherein the second urging portion from one of said first eccentric bearings toward said second eccentric bearing and the third urging portion from said second eccentric bearing toward the other one of said support members are substantially located on a line that connects two axes of said first and second cylinders.

6. An apparatus according to claim 5, wherein the first urging portion from the other one of said first eccentric bearings toward the other one of said support members is substantially located on a line that connects the two axes of said first and second cylinders.

7. An apparatus according to claim 1, wherein the abutting portions comprise engaging projections projecting from outer surfaces of said first eccentric bearings, said abutting members comprises eccentric cams, and when said eccentric cams are pivotally adjusted, abutting positions where the engaging projections and said eccentric cams abut change to adjust a nip pressure between said first and second cylinders.

8. An apparatus according to claim 1, wherein said first cylinder comprises a plurality of first cylinders arranged around said second cylinder, and said first eccentric bearings with the abutting portions, said second eccentric bearing, said support members, said first and second driving means, and said abutting portions are provided to correspond to each of said plurality of first cylinders.

9. An apparatus according to claim 1, wherein said first cylinder is a plate cylinder, and said second cylinder is a blanket cylinder.

10. An apparatus according to claim 1, wherein the second eccentric bearing and the one of the first eccentric bearings form a double eccentric bearing assembly in which the second eccentric bearing is disposed outside of the one of the first eccentric bearings.

11. An apparatus according to claim 10, wherein the second eccentric bearing is pivotable with respect to the one of the first eccentric bearings to enable non-parallel adjustment of the first cylinder with respect to the second cylinder.

12. An apparatus for a rotary printing press having at least one plate cylinder and a blanket cylinder, comprising:

a first bearing assembly coupled to a support member to rotatatively support a first end of the plate cylinder;

a second bearing assembly coupled to the support member to rotatatively support a second end of the plate cylinder, said second bearing assembly including an inner bearing and an outer bearing disposed outside of the inner bearing, wherein the outer hearing of the second bearing assembly is pivotable with respect to the inner bearing to enable non-parallel adjustment of the plate cylinder with respect to the blanket cylinder; and abutting portions formed on said first and second bearing assemblies so as to cause (1) a portion of the first bearing assembly to press against the support member, (2) a portion of the inner bearing of the second bearing assembly to press against the outer bearing thereof, and (3) a portion of the outer bearing of the second bearing assembly to press against the support member, when the plate cylinder and the blanket cylinder are positioned for printing.

* * * * *